US005705988A

United States Patent [19]

McMaster

[11] Patent Number: 5,705,988

[45] Date of Patent: Jan. 6, 1998

[54] PHOTOELECTRIC SMOKE DETECTOR WITH COUNT BASED A/D AND D/A CONVERTER

[75] Inventor: Richard L. McMaster, Rochester, N.Y.

[73] Assignee: Detection Systems, Inc., Fairport, N.Y.

[21] Appl. No.: 676,712

[22] Filed: Jul. 8, 1996

[51] Int. Cl.[6] ..... G08B 17/10

[52] U.S. Cl. ..... 340/628; 340/530; 340/630

[58] Field of Search ..... 340/529, 530, 340/628, 630, 578, 693

[56] References Cited

U.S. PATENT DOCUMENTS

| | | | |
|---|---|---|---|
| 4,123,658 | 10/1978 | Kajii | 340/529 |
| 5,365,223 | 11/1994 | Sigafus | 340/578 |
| 5,530,433 | 6/1996 | Morita | 340/630 |
| 5,543,777 | 8/1996 | Vane et al. | 340/630 |
| 5,546,074 | 8/1996 | Bernal et al. | 340/630 |
| 5,552,765 | 9/1996 | Vane et al. | 340/630 |

*Primary Examiner*—Jeffery Hofsass
*Assistant Examiner*—Timothy Edwards, Jr.
*Attorney, Agent, or Firm*—J. Addison Mathews

[57] ABSTRACT

A method and apparatus in a smoke detector for comparing an analog signal voltage to a digital alarm threshold and for converting a digital sensitivity value to an analog test voltage. The analog signal voltage is converted to a digital value by: a) charging a capacitor at a first linear rate directly proportional to the analog signal voltage, for a predetermined time period; b) discharging the capacitor at a second predetermined linear rate to a predetermined threshold; c) counting during the discharging of the capacitor to establish a digital count representing the signal voltage; and, d) comparing the digital count to a an alarm threshold stored in the detector prior to its installation. The digital sensitivity value is converted to the analog test voltage by: charging the capacitor from the first predetermined voltage, at a predetermined rate, for a time period based on the sensitivity and a calibrated conversion factor. This charges the capacitor to an analog voltage representing the sensitivity.

3 Claims, 6 Drawing Sheets

| a | COLUMN | 1 | 2 | 3 | 4 | 5 |
|---|---|---|---|---|---|---|
| b | PROPERTY & LOCATION | V@89 | V@82 | V@96 | I@90 | STOP RAMP AT |
| c | SIGNAL RAMP UP | VBGI | VBGI + Vs (PLUSE) | -Vs (PULSE) | Vs(PULSE) / R90 | COUNT OF 1024 |
| d | SIGNAL RAMP DOWN | VBG2 | VBGI | VBG2-VBGI | (VBG2-VBGI)/R90 | VBGI |
| e | CAL RAMP UP | OV | VBGI | -VBGI | -VBGI / R | VBG2 |
| f | CAL RAMP DOWN | VBG2 | VBGI | VBG2-VBGI | (VBG2-VBGI) / R90 | VBGI |
| g | ANALOG RAMP UP | OV | VBGI | -VBGI | -VBGI / R90 | CALCULATED COUNT |

PHOTOELECTRIC SMOKE DETECTOR WITH COUNT BASED A/D AND D/A CONVERTER

FIELD OF INVENTION

The invention relates to smoke detectors and more specifically to photoelectric smoke detectors that convert sample and test signals between digital and analog values.

BACKGROUND OF THE INVENTION

Many fire or smoke detecting systems include individual detecting units that operate relatively independently of central control. They may receive power from a central panel, and report detected events there, but other important operations are completed locally within each respective detector.

Examples, similar in many respects to the preferred embodiment of the present invention, are disclosed in Vane et al. applications Ser. Nos. 08/089,539 and 08/059,540, filed on Jul. 12, 1993, and Ser. No. 08/598,300, filed on Feb. 8, 1996. Vane et al. disclose smoke detectors that project a light beam across an otherwise dark chamber. When smoke particles are present in the chamber, they reflect light out of the beam to a photosensitive element, which produces an analog signal proportional to the reflected light. The analog signal is peak detected and converted to a digital signal for processing and comparison to an alarm threshold. When the threshold is exceeded, the detector activates a local alarm, such as a light emitting diode (LED), and sends an alarm notification signal to a remote panel.

The Vane et al. detectors also include a testing sequence that digitally calculates detector sensitivity from instantaneous samples and data stored in the detector when it is manufactured. The digital result is converted to an analog signal and made available outside the detector for reading by test equipment.

The approach taken by Vane et al. has numerous advantages for detecting fires early while also reducing false alarms. It will become apparent from the following description, however, that mechanisms in smoke detectors for converting between digital and analog values can be improved significantly in accordance with the present invention. Detector components can be combined in accordance with this invention using a count based conversion between analog and digital values that eliminates timing and drift problems associated with many prior art approaches.

SUMMARY OF THE INVENTION

The present invention is directed to overcoming one or more of the problems set forth above and to providing improved smoke detectors that convert sample and test signals between digital and analog values. Briefly summarized, one aspect of the invention provides a method in a smoke detector for comparing an analog signal voltage to a digital alarm threshold. The method includes the steps of: a) charging a capacitor at a first linear rate directly proportional to the analog signal voltage, for a predetermined time period; b) discharging the capacitor at a second predetermined linear rate to a predetermined threshold; c) counting during the discharging of the capacitor to establish a digital count representing the signal voltage; and, d) comparing the digital count to an alarm threshold stored in the detector prior to its installation.

Another aspect of the invention relates to a smoke detector that converts an analog signal voltage, representing smoke, into a digital value that is compared to a digitally stored alarm threshold. The detector includes a control operating an integrating amplifier: a) to charge a capacitor for a predetermined period at a first linear rate directly proportional to the analog signal voltage and b) then to discharge the capacitor at a second predetermined linear rate, independent of the signal voltage, to a predetermined threshold. The control c) counts digitally during the discharging of the capacitor to establish a digital count representing the signal voltage and d) compares the digital count to a previously stored alarm threshold.

Still other aspects of the invention include a method and apparatus for providing an analog test voltage representing the sensitivity of a smoke detector. The sensitivity is calculated digitally from instantaneous measurements and previously stored data. According to this aspect, a capacitor is charged at a predetermined linear rate from a first predetermined voltage to a second predetermined voltage, thereby establishing a charging time period. A microprocessor counts during the charging time period to establish a digital count representing the time period. The first and second predetermined voltages and the digital count are used to determine a calibrated conversion factor in volts per digital count. The capacitor is then discharged and recharged from the first predetermined voltage, at the predetermined rate, for a time period based on the calculated sensitivity and the calibrated conversion factor. This charges the capacitor to an analog voltage representing the calculated sensitivity. A buffer protects the capacitor from discharging when a test meter is coupled to the detector to read the analog voltage.

DETAILED DESCRIPTION OF THE INVENTION

Figure 1:
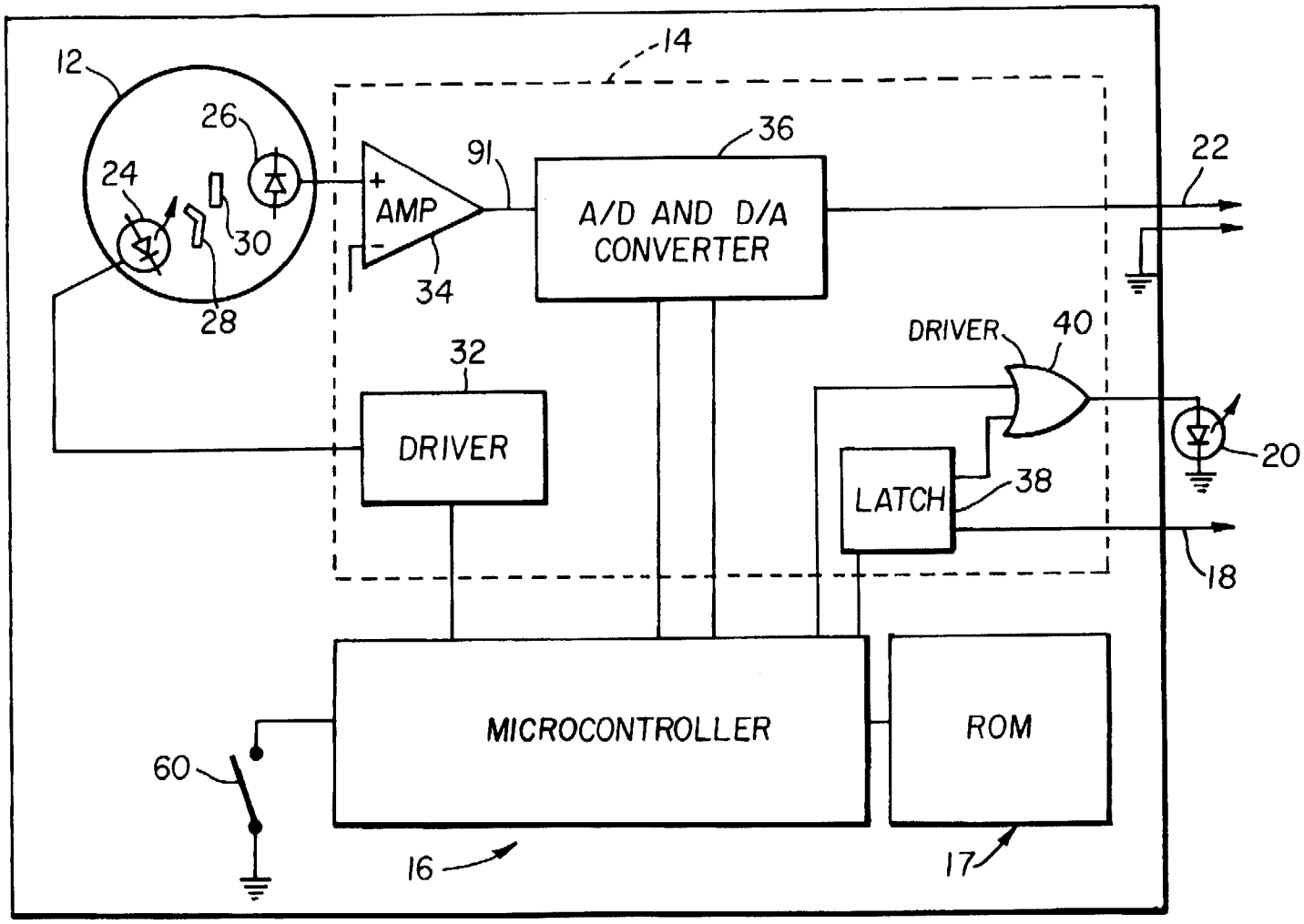
FIG. 1 is a block diagram depicting a smoke detector in accordance with a preferred embodiment of the invention.

Referring now to FIG. 1, a preferred embodiment of a smoke detector 10 is depicted in accordance with the present invention, including a dark chamber 12, ASIC 14, microcontroller 16, including appropriate memory 17, alarm signal output 18, visible light emitting diode (VLED) 20, and test voltage pins 22.

The chamber 12 is disclosed more fully in U.S. Pat. No. 5,400,014, and will not be described in detail here. Briefly, however, it is defined by a hollow base and cap separated by a peripheral wall. The wall includes interlocking fingers that block light from entering the chamber but do not impede airflow through the chamber.

The dark chamber 12 contains an photo-emitter 24 and photosensor 26 positioned on opposite sides of the chamber 12. The emitter 24 is an infrared light emitting diode (IRLED) which directs a beam or spot of infrared energy across the chamber 12 at an angle of approximately 140 degrees relative to the field-of-view of photosensor 26. Upstanding baffles 28 and 30 further confine the beam to its desired path. The photosensor 26 is a photo diode mounted out of the infrared beam, but aimed to view the chamber and intercept optical energy scattered from the beam by reflection from any smoke particles. Although not apparent from the drawings, the photo diode actually is below the chamber and light is focused on it by a prism and lens assembly that extend into the chamber through its base.

Under clean-ambient conditions, there is little background scatter in chamber 12, and the infrared radiation reaching photosensor 26 is very low. When airborne smoke enters the chamber, however, it moves through the beam and reflects optical energy in all directions, significantly increasing the infrared radiation on photosensor 26. The electrical output of the photosensor is proportional to the infrared radiation on the sensor, and when the resulting signal exceeds a predetermined threshold, an alarm is activated. The alarm includes visual or audible warnings issued from the alarm itself, such as the visible light emitting diode (VLED) 20. It also includes external sound generators activated from a central control panel. A detector alarm signal is sent to the panel through alarm signal output 18.

The emitter 24 is pulsed on for fifty microseconds (50 μsec.) every seven seconds (7 sec.) by a temperature compensated current driver 32. The current output of the photosensor 26 is amplified by an operational amplifier 34, configured as a DC coupled current amplifier. After amplification, the analog signal is converted to a digital representation of the sensor output by converter 36. Converter 36, which will be described more fully hereinafter, includes a sample and hold circuit, an analog-to-digital (A/D) converter and a digital-to-analog (D/A) converter.

Operation of the smoke detector is controlled by the microcontroller 16, including signal processing logic, and using appropriate memory 17. It is the microcontroller that times the emitter pulses and coordinates sampling of the photosensor output signal.

Prior to installation of the smoke detector, preferably during its manufacture, each detector is calibrated on an individual basis and the resulting calibration factors are stored in microcontroller memory for later use.

A first calibration factor represents an alarm condition, and is determined by circulating through chamber 12, a gaseous or aerosol calibration medium. The calibration medium represents the lowest percent obscuration per foot that should cause the detector to issue an alarm. The output signal that results from the test is measured and stored as a digital count, for use by the detector during its operation.

A second calibration factor represents a corresponding output signal under clean-ambient conditions. This signal is measured without obscuration and is stored as a digital count in microcontroller memory for monitoring the sensitivity of the detector throughout its useful life. Alternative embodiments might store: a) either one of the output signals and the difference between them, or b) values in look-up tables that represent the desired calibration factors.

Still other calibration factors represent the range of acceptable sensitivities, from a maximum value to a minimum value, that will be used for test purposes to be described more fully hereinafter.

After installation of the detector, and during its operation, the detector repeatedly samples the output from photosensor 26 and compares the output to the stored value representing an alarm condition. If the sampled value exceeds the alarm threshold, the microcontroller sends an alarm signal through latch 38 to output 18 and energizes visible light emitting diode 20 through driver 40. In the preferred embodiment, the alarm is activated only after the threshold is exceeded by three successive samples. This reduces the possibility of an alarm caused by transient conditions such as cigarette smoke or airborne dust.

Figure 2:
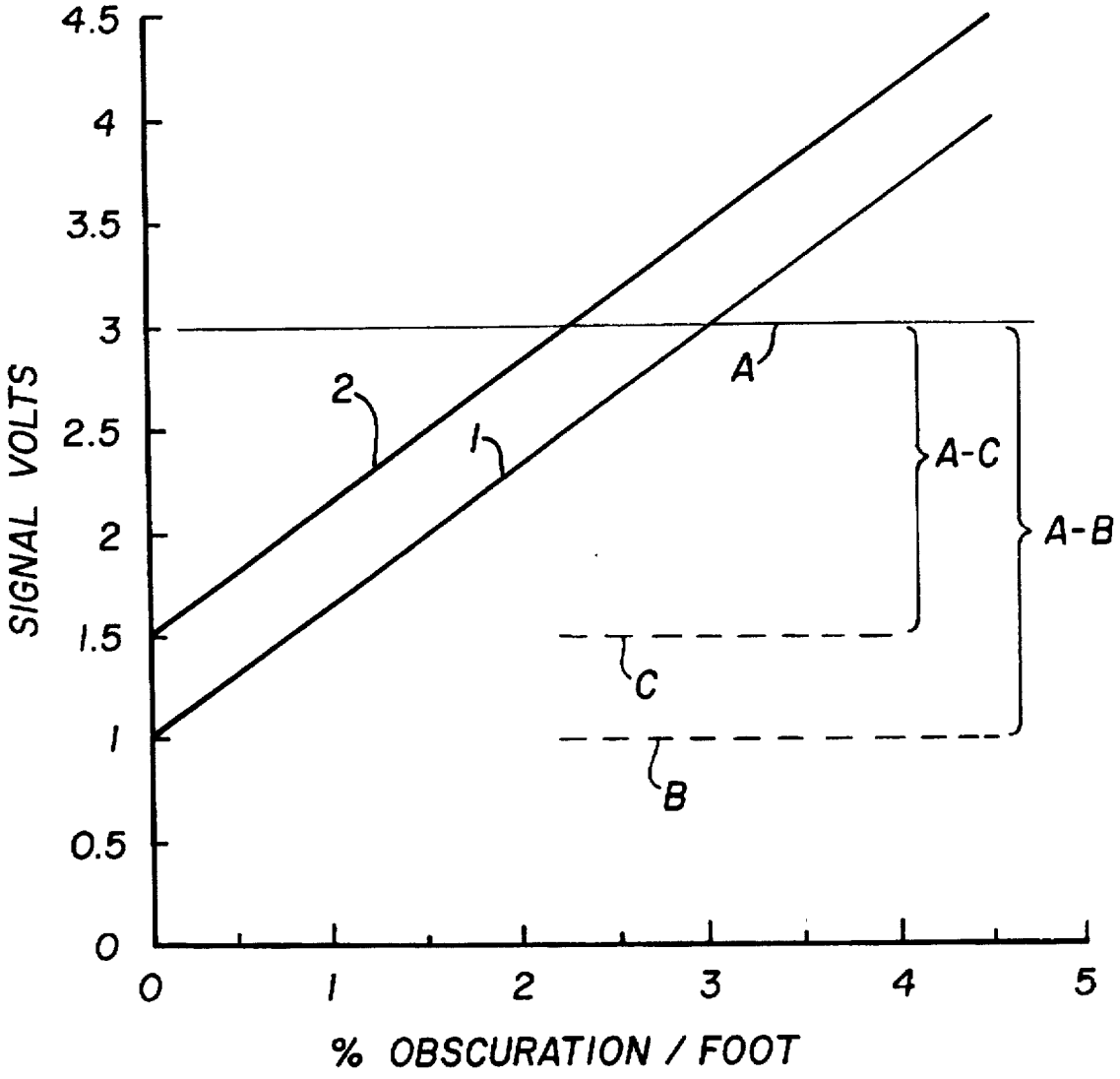
FIG. 2 is a graph showing calibration and test signals according to the operation of the preferred embodiment.

Referring now to FIG. 2, line 1 illustrates the response of the detector immediately following calibration. The abscissa or "X" axis depicts visible obscuration in percent per foot, and the ordinate or "Y" axis depicts the analog signal voltage of the detector. Voltage "A" represents the alarm condition. In this example the detector alarms at three percent per foot obscuration, which is equal to the amount of obscuration in the gaseous medium used to calibrate the alarm threshold. Voltage "B" represents the clean-ambient condition. The difference between voltages "A" and "B" is the sensitivity of the detector when it is new, three percent per foot obscuration (3% obscuration/ft.) in this example.

Line 2 illustrates the response of the same detector at a later time, after installation. Dust and other reflective material may settle in the chamber, accumulating over time. This increases the background scatter and reduces the amount of smoke required to reach the alarm threshold, thereby increasing the sensitivity of the detector and its propensity to false alarm. Voltage "C" depicts the analog signal where line 2 intercepts the "Y" axis. The detector will now alarm at only two and a quarter percent obscuration per foot (2.25% obscuration/ft.). The obscuration at alarm has decreased, increasing the sensitivity of the detector.

Figure 3:
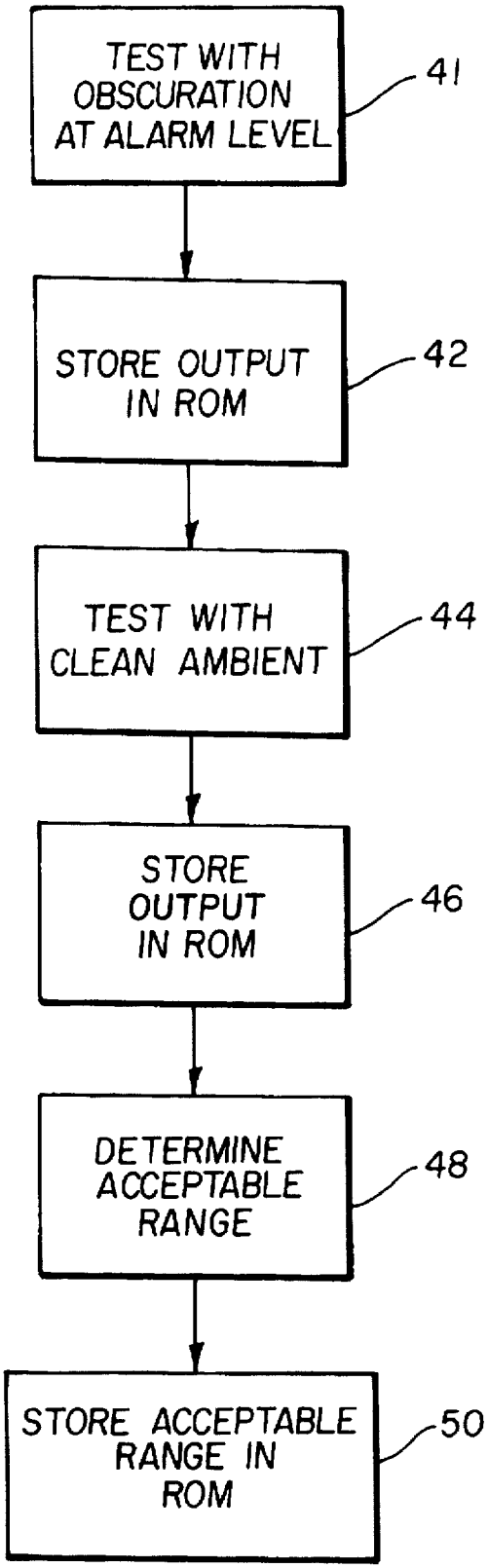
FIGS. 3 and 4 are flow diagrams depicting the operation of the preferred embodiment.

The information or calibration factors obtained during the initial calibration of each detector is used to determine and store a range of acceptable sensitivities for subsequent testing of the detector after its installation. Referring to FIG. 3, each detector is tested prior to installation, box 41, with a calibration sample representing an alarm condition, and the resulting output signal is stored in memory, box 42, for later use. The detector is tested under clean-ambient conditions at approximately the same time, box 44, and the resulting output, or difference, again is stored in memory for later use, box 46. An acceptable range of sensitivities is determined, box 48, and the range, or its limits, are stored in memory, box 50, for testing of the detector after its installation. The limits are selected based on the parameters of each individual detector prior to its installation, preferably during its manufacture, and are stored as digital values that remain with the detector throughout its useful life.

Figure 4:
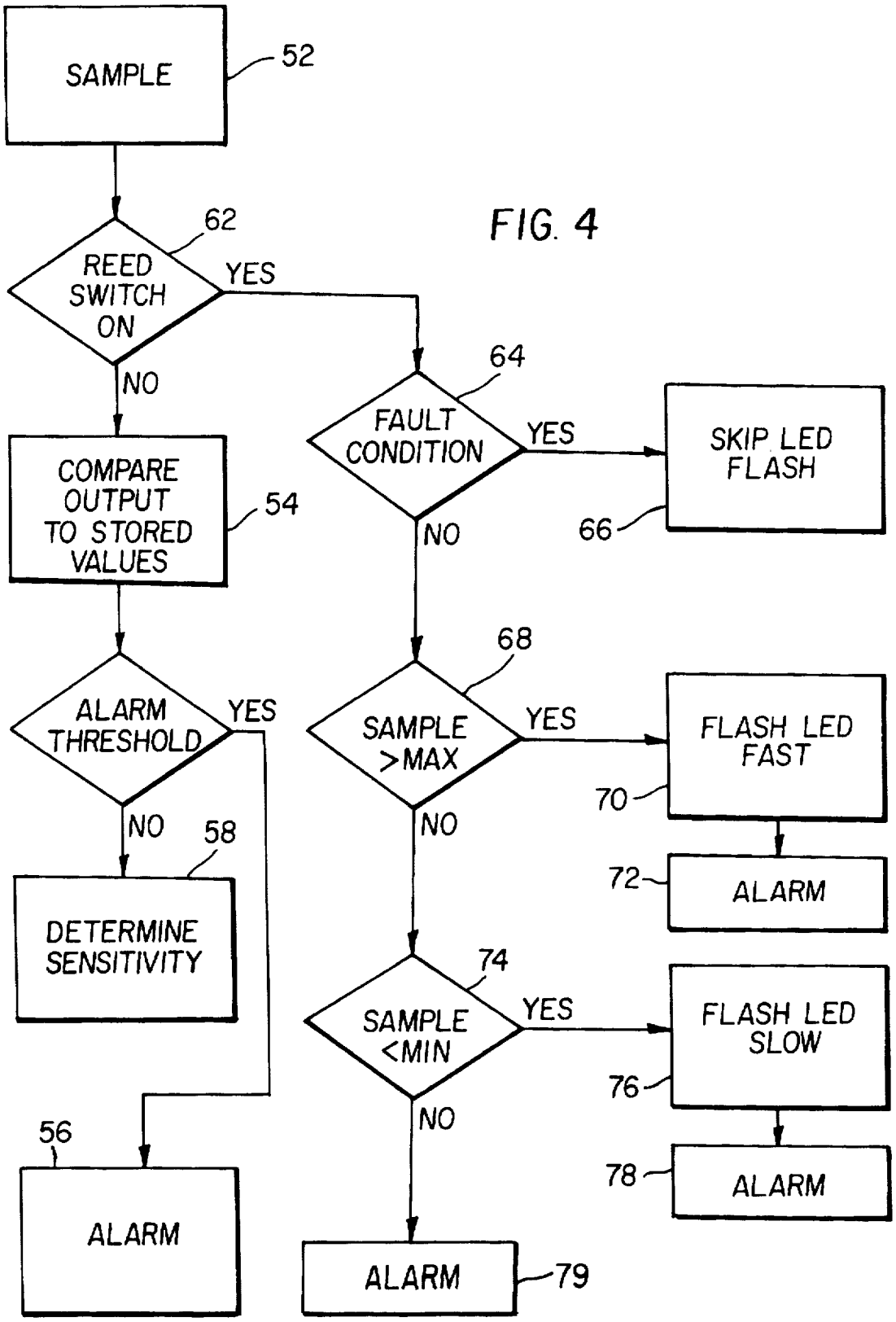

FIG. 4 represents steps for testing the detector both automatically and manually after its installation. Ambient conditions are sampled, box 52, and compared to the alarm threshold determined during calibration, box 54. If the monitored value exceeds the alarm threshold, the alarm is activated, box 56, as described above. If below the alarm threshold, the remaining sensitivity is determined, box 58, and made available through converter 36 as an analog signal at contacts 22 (FIG. 1).

The sensitivity determination is based on the relationships depicted in FIG. 2. Thus the sensitivity represented by voltage C can be determined from the ratio of the difference A–C over the difference A–B. An analog output signal based on this ratio is made available by microcontroller 16 at contacts 22.

Manual sensitivity testing is initiated through a magnetic reed switch 60 (FIG. 1). When the reed switch 60 is closed it initiates a test sequence, box 62 (FIG. 4). The microcontroller first tests for fault conditions, box 64. A fault condition has no visible output, box 66, which indicates a bad detector that must be replaced. If there is no fault condition, the test output is compared to the acceptable range. In the preferred embodiment the test output is compared first to a maximum at one end of the range, decision box 68. If the output exceeds the maximum, the LED 20 (FIG. 1) is flashed at a rapid rate such as twice a second, box 70, and the alarm is activated, box If the output does not exceed the maximum, it is compared to the minimum at the other end of the range, decision box 74.If below the minimum, the LED 20 (FIG. 2) is flashed at a slow rate, such as once every two seconds, box 76, and the alarm is activated, box 78. If the output is within the acceptable range, the LED does not flash, but the alarm is activated to indicate a successful test, box 79.

Referring now more specifically to the details of the present invention, and to FIGS. 5–8, converter 36 (FIG. 5) includes a switching device 80, sample and hold capacitor 82, integrating amplifier 84, comparator 86 and buffer amplifier 88. These components of converter 36 operate together, using a digital count based technique, to convert: a) sample signal voltages from analog to digital values and b) calculated sensitivity parameters from digital to analog values.

Figures 5, 6:
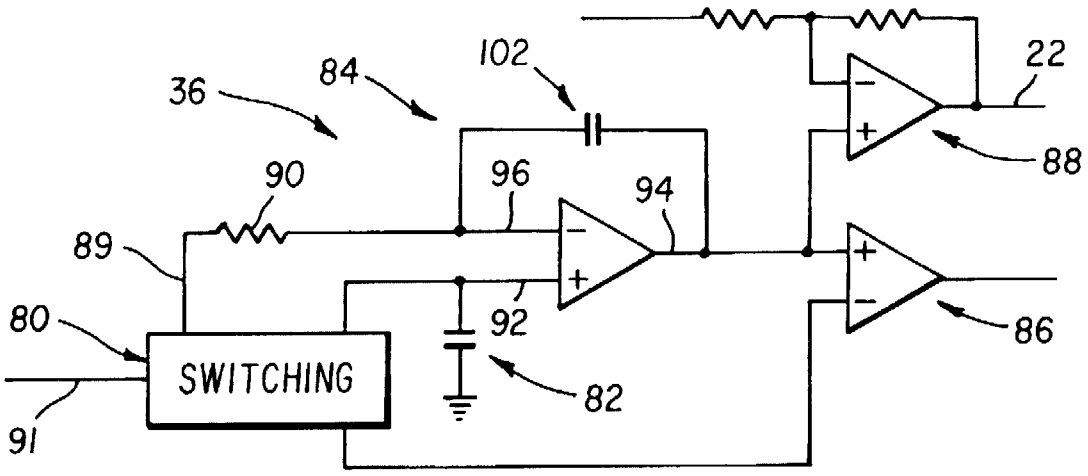
FIG. 5 is a schematic diagram of a conversion mechanism according to the preferred embodiment for converting sample and test voltages between analog and digital values.
FIG. 6 is a table identifying signals from the conversion mechanism of FIG. 5.
Figure 7:
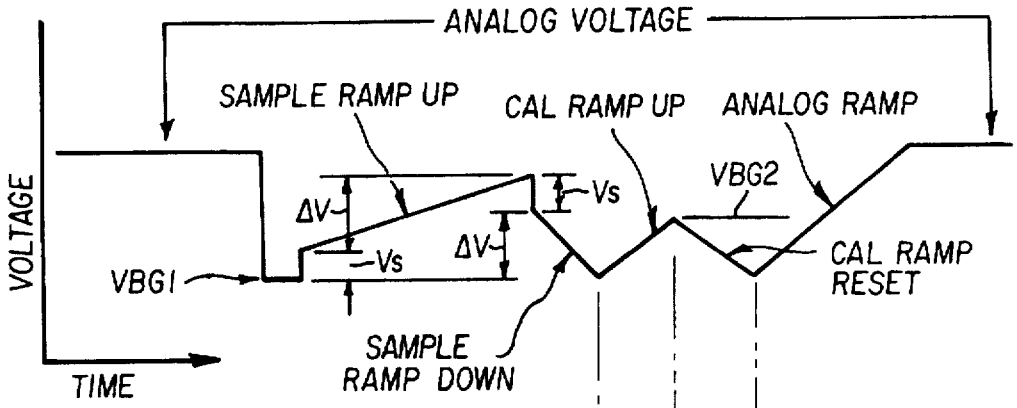
FIG. 7 is a graph of various signals for the conversion mechanism of FIG. 5.
Figure 8:
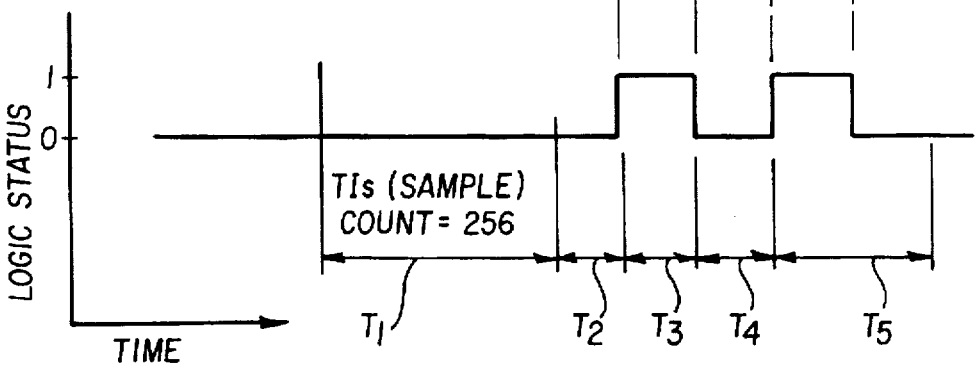
FIG. 8 is a graph of a time-line and comparator output for the conversion mechanism of FIG. 5.

The table of FIG. 6 presents current, voltage and digital count values at various points in time for the circuit of FIG. 5. Column 1 lists the voltage at node 89, or the input to resistor 90. Column 2 lists the voltage on sample and hold capacitor 82, or the non-inverting input to integrating amplifier 84. Column 3 lists the voltage difference between nodes 89 and 96, or across resistor 90. Column 4 lists the current through resistor 90. Column 5 lists the digital count or voltage at which ramping is stopped. Row "c" identifies values during signal ramp up. Row "d" lists values during signal ramp down. Row "e" lists values during calibration ramp up. Row "f" lists values during calibration ramp down and row "g" lists values during analog ramp up. FIG. 7 depicts the voltage at the integrating amplifier output, or node 94 (FIG. 5), for the signal, calibration and analog ramps and FIG. 8 shows time intervals and the output signals from comparator 86, which is an input to microcontroller 16.

Referring first to the analog-to-digital conversion of the sample signal, an integrating dual-slope technique is used with microcontroller 16 (FIG. 1) counting ramp time intervals.

Microcontroller 16 operates through switching device 80 (FIG. 5), enabling sample-and-hold capacitor 82 to follow the output of amplifier 34 (FIG. 1) at node 91. The capacitor 82 has a response that is fast enough to capture the peak amplified voltage, $V_s$, of the sample signal from photosensor 26, superimposed on the amplifier band gap voltage, $VBG_1$.

Sample and hold capacitor 82 is coupled to the non-inverting input 92 of integrating amplifier 84. Initially, the output 94 of the integrating amplifier 84 is the same as the non-inverting input 92, or $VBG_1+V_s$. Amplifier feedback causes the inverting input 96 to be the same as the non-inverting input 92.

Conductor 89 is then switched to a reference voltage of $VBG_1$, imposing a voltage drop of $-V_s$ across resistor 90. This creates a constant current source for charging capacitor 102 at a linear rate proportional to the sample signal voltage, $V_s$. The constant current is equal to $-V_s/R_{90}$. Microcontroller 16 and switching device 80 initiate charging of capacitor 102 by switching the sample and hold signal to zero. The capacitor 102 voltage ramps up at a linear rate proportional to the amplified sample signal, $V_s$. The microcontroller counts to 256 and controls switching device 80 to end the up ramp, providing a conversion resolution of eight bits ($2^8$ or 256).

After the count of 1024, concluding the ramp up, the signal on capacitor 102 is ramped down at a predetermined rate to a predetermined value. The input to resistor 90, at node 89, is switched to $VBG_2$, which is twice $VBG_1$. Since $VBG_2$is greater than $VBG_1$, the direction of current is reversed in resistor 90. The predetermined rate depends on the current through resistor 90, which is $(VBG_2-VBG_1)/R_1$. The predetermined value is $VBG_1$. Microcontroller 16 counts during the ramp down to provide a digital count or number representing the signal voltage, $V_s$. The only error source is $VBG_2-VBG_1$, and these values are measured and stored in the detector when it is calibrated during manufacture.

After the microcontroller determines the count representing the signal voltage $V_s$, it compares the signal voltage count to the alarm threshold count as described above, and issues an alarm signal when the threshold count is exceeded.

When there is no alarm, the detector computes its instantaneous sensitivity as a digital value, and converts the digital value to an analog voltage made available at contacts 22 (FIG. 1). A calibration factor, in "counts per volt," is established by a calibration ramp up. The voltage on capacitor 102 is ramped from $VBG_1$ to $VBG_2$ and then back down again. The microcontroller counts during the up ramp time interval, and thereby establishes the counts per volt. The sensitivity of the detector computed digitally during the down ramp.

Row "g" on the table of FIG. 6 represts conversion of the digital sensitivity value to a corresponding analog value. Capacitor 102 is ramped up to the analog value, based on the calculated sensitivity and the counts-per-volt calibration factor. The resulting analog value is buffered by the amplifier 88, which has a very high input impedance and unity gain.

It should now be apparent that an improved method and apparatus are provided in a smoke detector for converting an analog signal voltage to a digital value and a digital sensitivity value to an analog test voltage. Both conversions use the same components and circuits, providing count based conversions that eliminate timing and most drift problems.

While the invention is described in connection with a preferred embodiment, other modifications and applications will occur to those skilled in the art. The claims should be interpreted to fairly cover all such modifications and applications within the true spirit and scope of the invention.

I claim:

1. A smoke detector including a digitally stored alarm threshold and comprising:

a photo-emitter and a photo-sensor, said photo-emitter producing a light beam and said photo-sensor providing an analog signal voltage proportional to light reflected out of said beam by smoke particles;

means for amplifying said analog signal voltage and for holding a sample of said amplified analog signal voltage;

an analog-to-digital converter converting said analog sample to a digital representation of said sample; and, a control comparing said digital representation to said digitally stored alarm threshold;

said analog-to-digital converter comprising an integrating amplifier operated by said control a) to charge a capacitor for a predetermined period at a first linear rate directly proportional to said analog sample and b) then to discharge said capacitor at a second predetermined linear rate to a predetermined threshold;

said control counting digitally during said discharging of said capacitor to establish said digital representation of said sample;

wherein said controller determines a calibrated digital-to-analog conversion factor by a) operating said integrating amplifier to charge said capacitor at a predetermined linear rate, from a first predetermined voltage to a second predetermined voltage, thereby establishing a charging time period, b) counting digitally during said charging time period to establish a digital count representing said charging time period and c) using said digital count and said first and second predetermined voltages to provide said conversion factor in volts per count; and, wherein said controller operates said integrating amplifier to charge said capacitor from said first predetermined voltage at said predetermined rate for a time period based on said calibrated conversion factor to produce an analog voltage representing detector sensitivity.

2. A method of providing an analog test voltage representing sensitivity of a smoke detector, the smoke detector digitally calculating said sensitivity from measured and previously stored values; said method comprising the steps of:

charging said capacitor at a predetermined linear rate from a first predetermined voltage to a second predetermined voltage, thereby establishing a charging time period;

counting digitally during said charging time period to establish a digital count representing said time period;

using said first and second predetermined voltages and said digital count to determine a calibrated conversion factor representing volts per digital count;

charging said capacitor from said first predetermined voltage, at said predetermined rate, for a time period based on said calculated sensitivity and said calibrated conversion factor, thereby providing said analog test voltage.

3. A smoke detector having a controller digitally calculating detector sensitivity from measured and previously stored values; said detector comprising:

an integrating amplifier operated by said controller to charge a capacitor at a predetermined linear rate, from a first predetermined voltage to a second predetermined voltage, thereby establishing a charging time period;

said controller counting digitally during said charging time period to determine a calibrated conversion factor in volts per digital count;

said controller operating said integrating amplifier to charge said capacitor from said first predetermined voltage at said predetermined rate for a time period based on said calculated sensitivity and said calibrated conversion factor, thereby charging said capacitor to an analog voltage representing said sensitivity.

* * * * *